US011298725B2

(12) United States Patent
Nagai

(10) Patent No.: US 11,298,725 B2
(45) Date of Patent: Apr. 12, 2022

(54) SHEET MANUFACTURING APPARATUS

(71) Applicant: SEIKO EPSON CORPORATION, Tokyo (JP)

(72) Inventor: Yoshiyuki Nagai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 509 days.

(21) Appl. No.: 16/328,368

(22) PCT Filed: Aug. 21, 2017

(86) PCT No.: PCT/JP2017/029757
§ 371 (c)(1),
(2) Date: Feb. 26, 2019

(87) PCT Pub. No.: WO2018/043176
PCT Pub. Date: Mar. 8, 2018

(65) Prior Publication Data

US 2021/0276050 A1 Sep. 9, 2021

(30) Foreign Application Priority Data

Aug. 31, 2016 (JP) ..... JP2016-169131

(51) Int. Cl.

| | |
|---|---|
| ***B08B 1/02*** | (2006.01) |
| ***D21F 3/02*** | (2006.01) |
| ***D21F 3/08*** | (2006.01) |
| ***D21F 5/02*** | (2006.01) |
| ***D21G 1/00*** | (2006.01) |
| ***B08B 1/00*** | (2006.01) |

(52) U.S. Cl.
CPC ..... *B08B 1/02* (2013.01); *B08B 1/008* (2013.01); *D21F 3/0281* (2013.01); *D21F 3/08* (2013.01); *D21F 5/022* (2013.01); *D21G 1/0073* (2013.01)

(58) Field of Classification Search
CPC . D21F 1/32; D21F 3/0289; D21F 3/04; D21F 9/00; B08B 1/02; D21G 1/0073; D21G 1/0093; D21G 9/0027; D21G 9/0036; D04H 1/732; D01B 1/08; D01B 3/041
USPC ..... 162/198, 199, 272, 276
See application file for complete search history.

(56) References Cited

U.S. PATENT DOCUMENTS 4,686,132 A * 8/1987 Sumii ..... D04H 1/55 428/171
5,130,754 A * 7/1992 Hishikawa ..... G03G 15/1685 399/322
5,452,065 A * 9/1995 Bell ..... G03G 21/0041 399/148

(Continued)

FOREIGN PATENT DOCUMENTS

DE 10135658 A1 2/2003
JP 2002-509205 A 3/2002

(Continued)

*Primary Examiner* — Eric Hug
(74) *Attorney, Agent, or Firm* — Global IP Counselors, LLP

(57) ABSTRACT

A sheet manufacturing apparatus includes: a second web former that forms a web of defibrated substances obtained by defibrating a raw material containing fibers; and a sheet former that forms a sheet of the web formed by the second web former. The sheet former has a former roller unit and a cleaning unit that has an oil impregnated web for cleaning a roller surface of the former roller unit.

8 Claims, 5 Drawing Sheets

(56) References Cited

U.S. PATENT DOCUMENTS

| | | | | |
|---|---|---|---|---|
| 6,645,349 | B1 * | 11/2003 | Koivukunnas | D21G 1/0073 162/198 |
| 7,548,717 | B2 | 6/2009 | Tateishi et al. | |
| 7,585,393 | B2 * | 9/2009 | Sekiya | D21F 1/30 162/158 |
| 7,630,675 | B2 | 12/2009 | Tateishi et al. | |
| 8,532,529 | B2 * | 9/2013 | Kageyama | G03G 15/20 399/122 |
| 2010/0111578 | A1 * | 5/2010 | Derimiggio | G03G 15/2025 399/327 |
| 2016/0145801 | A1 * | 5/2016 | Fujita | B65H 20/06 162/289 |
| 2018/0237992 | A1 | 8/2018 | Nagai et al. | |

FOREIGN PATENT DOCUMENTS

| | | | |
|---|---|---|---|
| JP | 2006-330182 | A | 12/2006 |
| JP | 2008-015444 | A | 1/2008 |
| JP | 2013-123666 | A | 6/2013 |
| JP | 2016-098473 | A | 5/2016 |
| JP | 2009-269004 | A | 11/2019 |
| WO | 99/036616 | A1 | 7/1999 |
| WO | 93/011599 | A1 | 2/2003 |
| WO | 2016/113803 | A1 | 7/2016 |

* cited by examiner

SHEET MANUFACTURING APPARATUS

CROSS-REFERENCE TO RELATED APPLICATIONS

This application is a U.S. National stage application of International Patent Application No. PCT/JP2017/029757, filed on Aug. 21, 2017, which claims priority under 35 U.S.C. § 119(a) to Japanese Patent Application No. 2016-169131, filed in Japan on Aug. 31, 2016. The entire disclosure of Japanese Patent Application No. 2016-169131 is hereby incorporated herein by reference.

TECHNICAL FIELD

The present invention relates to a sheet manufacturing apparatus.

BACKGROUND ART

In the related art, fiber-shaped substances are accumulated, and a bonding force acts between accumulated fibers such that a sheet is manufactured.

In this case, a state of a roll surface of a paper machine or a paper finishing device is monitored, a cleaning/polishing belt is brought into press contact with the roll surface, and the roll surface is cleaned or polished (for example, see Japanese Unexamined Patent Application Publication (Translation of PCT Application) No. 2002-509205).

In recent years, instead of a sheet making method using water, which is widely used in the related art, a technology of manufacturing a sheet by a method called a dry method of using little or no water is used.

In the dry method, a web formed by mixing defibrated substances containing fibers and an additive such as a resin is pressurized-heated by a roller, and thereby the fibers are bound together with the additive such that a sheet is manufactured.

In this case, when fibers or an additive of the resin is attached to a surface of the roller in a step of pressurizing and heating the web, there is a concern that attached matter will be transferred to a sheet to be manufactured during pressurizing or heating. When the attached matter is transferred, there is a concern that deterioration of a sheet quality will be brought about, such as forming an uneven surface of a sheet.

SUMMARY

In order to solve such a problem, an object of the present invention is to remove attached matter attached on a surface of a roller and improve a quality of a sheet.

In order to achieve the object, a sheet manufacturing apparatus of the present invention includes: a web former that forms a web of defibrated substances obtained by defibrating a raw material containing fibers; and a sheet former that forms a sheet of the web formed by the web former. The sheet former has a former roller unit that pressurizes and heats the web formed by the web former so as to form a sheet and a cleaning unit that has an oil impregnated web for cleaning a roller surface of the former roller unit.

According to the present invention, since it is possible to remove the attached matter attached on the roller surface of the former roller unit by the oil impregnated web of the cleaning unit, it is possible to prevent the attached matter from being transferred to the sheet (web) on the former roller unit. As a result, it is possible to improve a quality of the sheet (achieve evenness) without forming an uneven surface of the sheet to be formed.

In the present invention, according to the above-described invention, the cleaning unit has a web delivery roller that delivers the oil impregnated web, a web winding roller around which the oil impregnated web is wound, and a web press-contact roller that is disposed between the web delivery roller and the web winding roller and comes into press contact with the roller surface of the former roller unit via the oil impregnated web.

According to the present invention, since the oil impregnated web is wound around the web winding roller via the web press-contact roller from the web delivery roller, it is possible to cause a new (unused part of) oil impregnated web to come into press contact with the roller surface.

In the present invention, according to the above-described invention, the former roller unit has a pressurizing roller pair, and rollers of the pressurizing roller pair are each provided with the cleaning unit.

According to the present invention, it is possible to clean the rollers of the pressurizing roller pair individually by the cleaning unit.

In the present invention, according to the above-described invention, the former roller unit has a scraping blade that removes attached matter on the roller surface of the pressurizing roller pair, and the cleaning unit performs cleaning on an upstream side of the scraping blade.

According to the present invention, since the cleaning unit performs cleaning, and then the attached matter is scraped by the scraping blade, the surfaces of the rollers of the pressurizing roller pair are in a state being applied with oil by the oil impregnated web. Therefore, the attached matter is likely to be scraped by the scraping blade, and it is possible to scrape the attached matter on the surface of the pressurizing roller pair efficiently.

In the present invention, according to the above-described invention, the former roller unit has a scraping blade that removes attached matter on the roller surface of the pressurizing roller pair, and the cleaning unit performs cleaning on a downstream side of the scraping blade.

According to the present invention, the attached matter is scraped by the scraping blade, and then the cleaning unit performs cleaning. Therefore, relatively larger attached matter is removed by the scraping blade, and then it is possible to remove fine attached matter by the cleaning unit.

In the present invention, according to the above-described invention, the former roller unit has a heating roller pair, and rollers of the heating roller pair are each provided with the cleaning unit.

According to the present invention, it is possible to clean the rollers of the heating roller pair individually by the cleaning unit.

In the present invention, according to the above-described invention, the sheet manufacturing apparatus further includes: an external heating roller that heats at least one heating roller of the heating roller pair from outside. The cleaning unit performs cleaning on an upstream side of the external heating roller.

According to the present invention, by the time of reaching the external heating roller, it is possible to remove the attached matter attached on the surface of the heating roller. Consequently, when the surface of the heating roller is heated by the external heating roller, it is possible to prevent the attached matter from being interposed between the heating roller and the external heating roller, and it is possible to uniformly heat the surface of the heating roller.

In the present invention, according to the above-described invention, the oil impregnated web of the cleaning unit is conveyed in a reverse direction of a roller rotating direction of the former roller unit.

According to the present invention, since the oil impregnated web is conveyed in the reverse direction of the roller rotating direction of the former roller unit, it is possible to remove the attached matter on the surface of the roller by the oil impregnated web while blocking the attached matter. As a result, it is possible to remove the surface attached matter of the roller efficiently.

In the present invention, according to the above-described invention, the oil impregnated web of the cleaning unit is conveyed intermittently.

According to the present invention, since the oil impregnated web is conveyed intermittently, the oil impregnated web blocks the attached matter on the surface of the roller when the conveyance of the oil impregnated web is stopped. Then, when the oil impregnated web is conveyed, it is possible to attach the blocked attached matter to the oil impregnated web so as to get rid of the attached matter, and it is possible to remove the surface attached matter of the roller efficiently.

In the present invention, according to the above-described invention, the cleaning unit is replaceable on a unit basis.

According to the present invention, since the oil impregnated web of the cleaning unit is a consumable item, it is possible to perform replacement on a unit basis, and thereby easy maintenance is achieved.

DESCRIPTION OF EMBODIMENTS

Hereinafter, embodiments of the present invention will be described with reference to the drawings.

Figure 1:
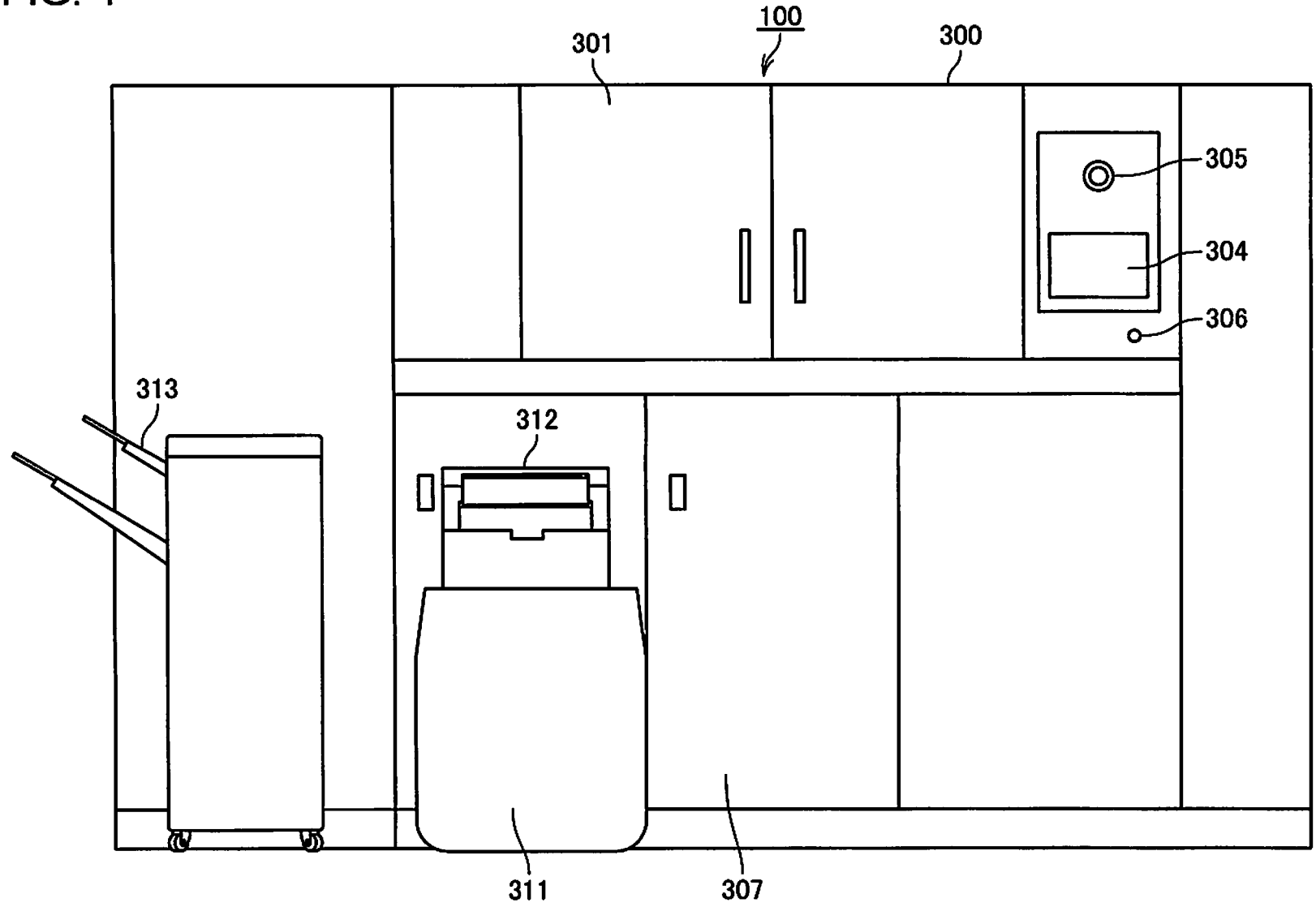
FIG. 1 is a front view of a sheet manufacturing apparatus according to the present invention.
Figure 2:
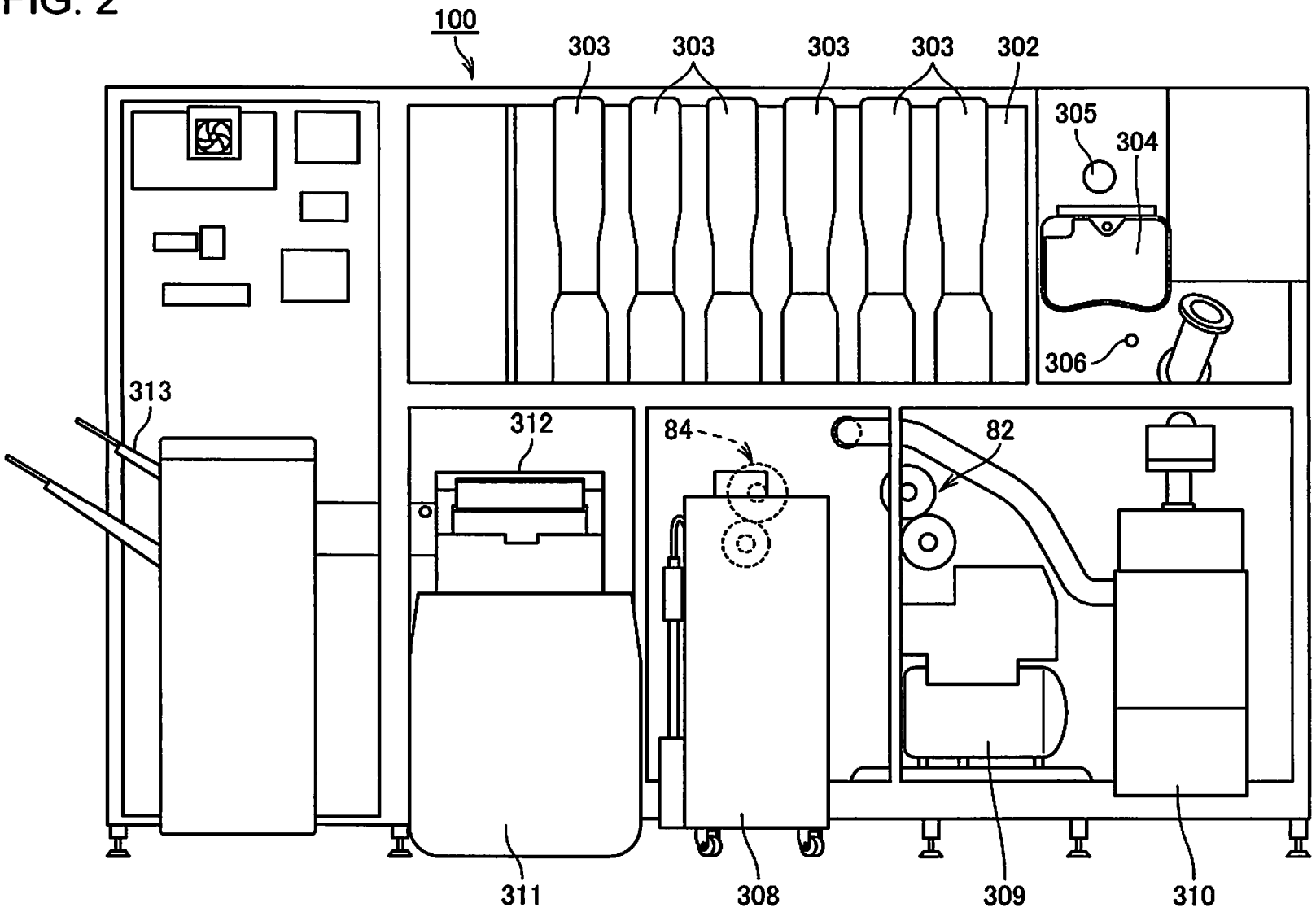
FIG. 2 is a schematic front view showing a state in which a front panel in FIG. 1 is detached.

FIG. 1 is a front view of a sheet manufacturing apparatus to which the present invention is applied. FIG. 2 is a schematic front view showing a state in which a front panel in FIG. 1 is detached.

For example, a sheet manufacturing apparatus 100 described in the embodiment is an apparatus that is suitable for defibrating used waste paper such as confidential paper as a raw material in a dry method such that the paper is fiberized and, then, manufacturing new paper through pressurization, heating, and cutting. The fiberized raw material is mixed with various additives, and thereby bond strength or a whiteness level of a paper product may improve or a function of coloring, scenting, or flame resisting may be added, depending on a use. In addition, forming is performed by controlling density, a thickness, and a shape of paper, and thereby it is possible to manufacture paper having various thicknesses or sizes, depending on a use such as office paper having an A4 or A3 size or business card paper.

As shown in FIGS. 1 and 2, the sheet manufacturing apparatus 100 includes a substantially rectangular parallelepiped-shaped housing 300. An opening/closing door 301 is provided in an upper portion at the center of a front surface of the housing 300 and opens and closes an opening provided in the upper portion of the front surface. The opening/closing door 301 can be opened and closed by using a handle.

When the opening/closing door 301 comes into an opened state, a resin cartridge housing portion 302 provided inside the housing 300 is exposed. The resin cartridge housing portion 302 detachably houses cartridges 303 in which additives containing a plurality of color resins are stored, respectively.

The opening/closing door 301 is formed of a transparent material, and thus a user is able to visually recognize a state of the cartridge 303 housed in the resin cartridge housing portion 302 without causing the opening/closing door 301 to come into the opened state.

As shown in FIG. 1, a touch panel 304 is provided on a right side of the opening/closing door 301, on the front surface of the housing 300. The touch panel 304 also functions as a display unit on which various items of information about the sheet manufacturing apparatus 100 are displayed.

As shown in FIG. 1, an emergency stop button 305 is provided above the touch panel 304, on the front surface of the housing 300. While the sheet manufacturing apparatus 100 executes a process of manufacturing a sheet, the emergency stop button 305 is a button for an instruction of an urgent stop of the corresponding process.

As shown in FIG. 1, a push-down power switch 306 is provided below the touch panel 304, on the front surface of the housing 300.

As shown in FIG. 1, a front cover 307 is provided below the opening/closing door 301, on the front surface of the housing 300. For example, the front cover 307 can be opened and closed by using a handle. When the front cover 307 comes into an opened state, an in-device tank 308, a compressor 309, and a dust collecting tank 310 provided inside the housing 300 are exposed. The front cover 307 is capable of coming into the opened state only in a state of being unlocked by a locking mechanism (not shown).

As shown in FIG. 1, a paper feed stacker 311 is provided in a state of projecting from the front surface, on a lower portion of the front surface of the housing 300. The paper feed stacker 311 is a device in which used paper is accommodated as a raw material. When a sheet is manufactured, based on the used paper, the used paper accommodated in the paper feed stacker 311 is supplied inside the housing 300 by predetermined means. A paper feed tray 312 for supplying sheets of used paper, which are manually fed, one by one or a plurality of sheets of used paper, which are set, one by one into the inside of the housing is installed above the paper feed stacker.

As shown in FIG. 1, the housing 300 is recessed toward a rear side, and thereby a space is formed in a left end portion of the front surface of the housing 300. A paper discharge tray 313 is provided in the space. The paper discharge tray 313 is a device in which sheets that are manufactured by the sheet manufacturing apparatus 100 are discharged and stored in order. It is possible to install a paper discharge stacker as an option in the paper discharge tray 313.

Figure 3:
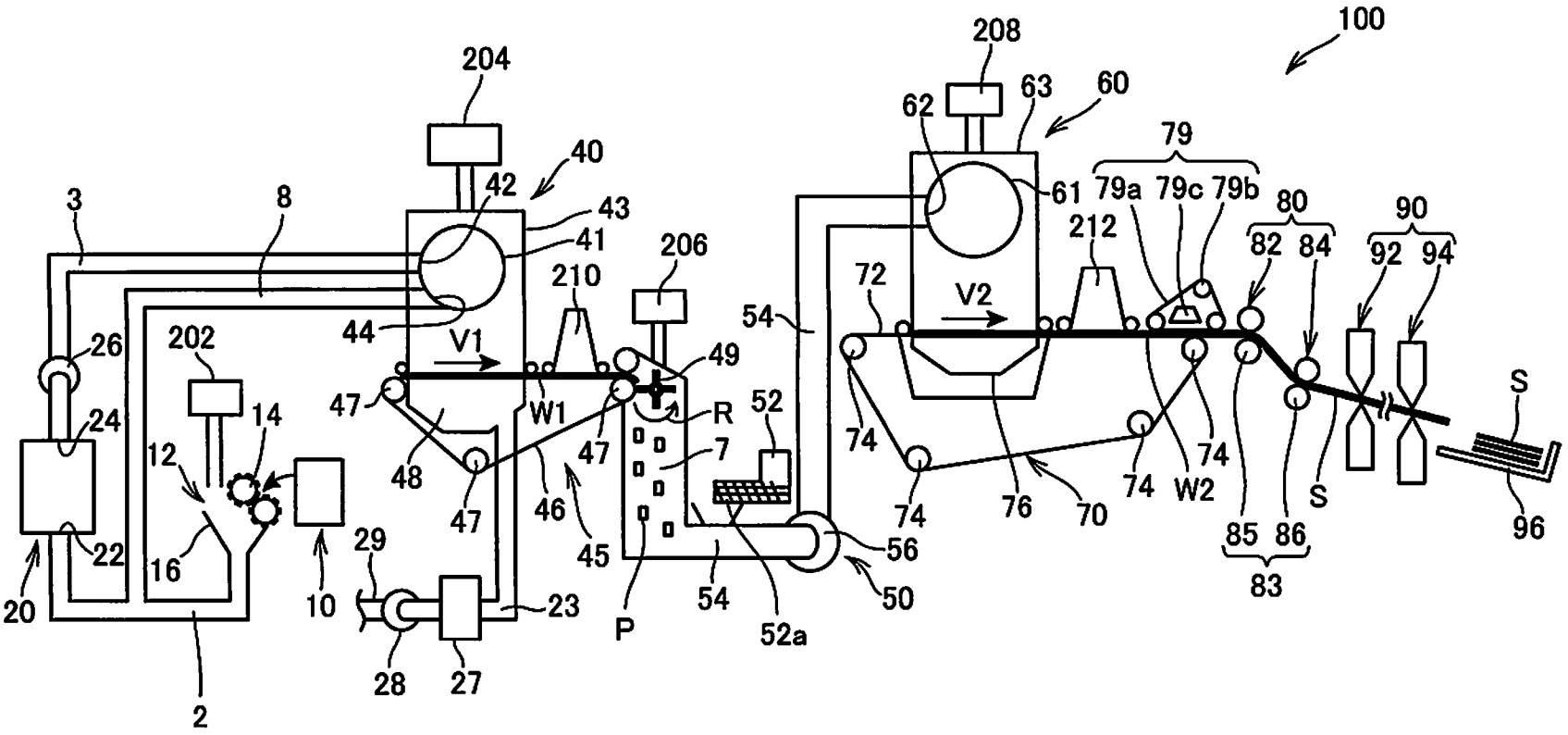
FIG. 3 is a schematic view showing a configuration and an operation of the sheet manufacturing apparatus.

FIG. 3 is a schematic view showing a configuration and an operation of the sheet manufacturing apparatus according to the embodiment.

As shown in FIG. 3, the sheet manufacturing apparatus 100 includes a supply unit 10, a rough crushing unit 12, a defibration unit 20, a sorting unit 40, a first web former 45, a rotary body 49, a mixer 50, an accumulation unit 60, a second web former 70, a conveying unit 79, a sheet former 80, and a cutter 90.

In addition, the sheet manufacturing apparatus 100 includes humidifying units 202, 204, 206, 208, 210, and 212 for the purpose of humidifying the raw material and/or a space through which the raw material moves. The humidifying units 202, 204, 206, 208, 210, and 212 have any specific configurations, and examples thereof include a steam type, a vaporization type, a hot air vaporization type, an ultrasound type, or the like.

In the embodiment, the humidifying units 202, 204, 206, and 208 are each configured of a vaporization-type or hot air vaporization-type humidifier. In other words, each of the humidifying units 202, 204, 206, and 208 has a filter (not shown) into which water infiltrates and causes air to pass through the filter, thereby supplying humidified air having high humidity.

In addition, in the embodiment, the humidifying unit 210 and the humidifying unit 212 are each configured of an ultrasound type humidifier. In other words, each of the humidifying units 210 and 212 has a vibrating unit (not shown), which atomizes water, and supplies mist generated by the vibrating unit.

The supply unit 10 supplies the raw material to the rough crushing unit 12. For example, any material may be used as the raw material of the sheet that is manufactured by the sheet manufacturing apparatus 100 as long as the material contains fiber, and examples of the raw material include paper, pulp, a pulp sheet, fabric containing nonwoven fabric, woven fabric, or the like. The embodiment employs a configuration in which the sheet manufacturing apparatus 100 uses used paper as the raw material. The embodiment employs a configuration, in which the supply unit 10 has the paper feed stacker 311, in which the sheets of used paper overlap each other and are accumulated, and an operation of a paper feed motor (not shown) causes the paper feed stacker 311 to deliver the used paper to the rough crushing unit 12.

The rough crushing unit 12 has rough crushing blades 14 that cuts (roughly crushes) the raw material supplied by the supply unit 10 into rough-crushed pieces. The rough crushing blades 14 cut the raw material in a gas atmosphere such as in the atmosphere (in the air). For example, the rough crushing unit 12 includes a pair of rough crushing blades 14, which pinches and cuts the raw material, and a drive unit, which rotates the rough crushing blades 14, and the rough crushing unit can have the same configuration as that of a so-called shredder. The rough-crushed pieces may have any shape or size as long as the shape or size is suitable for a defibrating process in the defibration unit 20. For example, the rough crushing unit 12 cuts the raw material into paper pieces having a size equal to or smaller than 1 square centimeter to several square centimeters.

The rough crushing unit 12 has a chute (hopper) 16 that receives the rough-crushed pieces which are cut by the rough crushing blades 14 and fall down. For example, the chute 16 has a tapered shape having a width that is gradually decreased in a direction (proceeding direction) in which the rough-crushed pieces flow. Therefore, the chute 16 is capable of receiving a large amount of rough-crushed pieces. A pipe 2 that communicates with the defibration unit 20 is connected to the chute 16, and the pipe 2 forms a conveying channel for conveying the raw material (rough-crushed pieces) cut by the rough crushing blades 14 to the defibration unit 20. The rough-crushed pieces are gathered by the chute 16 and are transported (conveyed) to the defibration unit 20 through the pipe 2.

The humidifying unit 202 supplies humidified air to the chute 16 or the vicinity of the chute 16 included in the rough crushing unit 12. Consequently, it is possible to suppress a phenomenon in which rough-crushed materials cut by the rough crushing blades 14 are attached to an inner surface of the chute 16 or the pipe 2 due to static electricity. In addition, the rough-crushed materials cut by the rough crushing blades 14 are transported together with humidified air (having high humidity) to the defibration unit 20, and thus it is also possible to expect an effect of suppressing attachment of a defibrated substance to an inside of the defibration unit 20. In addition, the humidifying unit 202 may be configured to supply the humidified air to the rough crushing blades 14 so as to remove electricity from the raw material that is supplied by the supply unit 10. In addition, an ionizer together with the humidifying unit 202 may remove electricity.

The defibration unit 20 performs a defibrating process on the raw material (rough-crushed pieces) cut by the rough crushing unit 12 and generates the defibrated substance. Here, "to defibrate" means to unravel fibers one by one from the raw material (defibration target object) in which a plurality of fibers are bound. The defibration unit 20 also has a function of separating a substance such as a resin grain, ink, toner, or a bleeding preventive agent, which is attached to the raw material, from the fiber.

A substance having passed through the defibration unit 20 is referred to as the "defibrated substance". The "defibrated substance" includes a resin (resin for binding a plurality of fibers to each other) grain, a coloring agent such as ink or toner, or an additive such as a bleeding preventive agent or a paper strengthening agent, which is separated from the fiber when the fiber is unraveled, in addition to an unraveled defibrated fiber, in some cases. The unraveled defibrated substance which has a string shape or a ribbon shape. The unraveled defibrated substance may be present in a state in which the substance is not intertwined with another unraveled fiber (an independent state) or may be present in a state in which the substance is intertwined with another unraveled defibrated substance into a blocking shape (a state of forming a so-called "clump".

The defibration unit 20 performs dry defibration. Here, defibration performed through a process of defibration not in a liquid but in a gas such as in the atmosphere (in the air) is referred to as the dry defibration. In the embodiment, the defibration unit 20 is configured of an impeller mill. Specifically, the defibration unit 20 includes a rotor (not shown) that rotates at a high speed and a liner (now shown) that is positioned along an outer circumference of the roller. The rough-crushed pieces that have been roughly crushed by the rough crushing unit 12 are sandwiched between the rotor and the liner of the defibration unit 20 so as to be defibrated. The defibration unit 20 generates an air current due to the rotation of the rotor. The air current enables the defibration unit 20 to suction the rough-crushed pieces which are the raw material from the pipe 2 and convey the defibrated substance to a discharge port 24. The defibrated substance is delivered to a pipe 3 from the discharge port 24 and is transported to the sorting unit 40 via the pipe 3.

In this manner, the defibrated substance that is generated in the defibration unit 20 is conveyed to the sorting unit 40 from the defibration unit 20 due to the air current that is generated by the defibration unit 20. Further, in the embodiment, the sheet manufacturing apparatus 100 includes a defibration unit blower 26 that is an air current generating device, and the defibrated substance is conveyed to the sorting unit 40 due to the air current generated by the defibration unit blower 26. As shown in FIG. 2, the defibration unit blower 26 is attached to the pipe 3, suctions air together with the defibrated substance from the defibration unit 20, and performs blowing to the sorting unit 40.

The sorting unit 40 is provided with an introduction port 42 into which the defibrated substance defibrated by the defibration unit 20 flows along with the air current from the pipe 3. The sorting unit 40 sorts the defibrated substance introduced to the introduction port 42 depending on a length of fiber. To be more specific, the sorting unit 40 sorts a defibrated substance having a size equal to or smaller than a predetermined size into a first sorted substance, and a defibrated substance that is larger than the first sorted substance into a second sorted substance, of defibrated substances defibrated by the defibration unit 20. The first sorted substance includes a fiber, a grain, or the like, and a second sorted substance includes a long fiber, an incompletely defibrated piece (rough-crushed piece that is not sufficiently defibrated), a clump formed by clumping or entwining the defibrated fibers, or the like.

In the embodiment, the sorting unit 40 has a drum portion (sieve portion) 41 and a housing portion (cover portion) 43 that accommodates the drum portion 41.

The drum portion 41 is a cylinder sieve that is rotatably driven by a motor. The drum portion 41 has a net (a filter or a screen) and functions as a sieve. The drum portion 41 sorts into the first sorted substance smaller than a size of a mesh opening (opening) of the net and the second sorted substance larger than the mesh opening of the net, by meshes of the net. Examples of the net of the drum portion 41 include a wire mesh, expanded metal obtained by expanding a metal plate provided with cuts, or punched metal provided with holes formed in a metal plate by a press machine.

The defibrated substance introduced into the introduction port 42 is delivered along with the air current into the inside of the drum portion 41, and the first sorted substance falls downward from the mesh of the net of the drum portion 41 due to the rotation of the drum portion 41. The second sorted substance that cannot pass through the mesh of the net of the drum portion 41 flows to be guided to a discharge port 44 and is delivered to a pipe 8 along with the air current flowing to the drum portion 41 from the introduction port 42.

The pipe 8 connects the inside of the drum portion 41 to the pipe 2. The second sorted substance flowing through the pipe 8 flows to the pipe 2 along with the rough-crushed pieces that have been roughly crushed by the rough crushing unit 12 and is guided to an introduction port 22 of the defibration unit 20. Consequently, the second sorted substance returns to the defibration unit 20 and is subjected to a defibrating process.

In addition, the first sorted substances sorted by the drum portion 41 are dispersed in the air through the meshes of the net of the drum portion 41 and drop toward a mesh belt 46 of the first web former 45 that is positioned below the drum portion 41.

The first web former 45 (separation unit) includes the mesh belt 46 (separation belt), a stretching roller 47, and a suction unit (suction mechanism) 48. The mesh belt 46 is an endless belt, is suspended on three stretching rollers 47, and is conveyed along with motion of the stretching rollers 47 in a direction represented by an arrow in the drawing. The mesh belt 46 has a surface configured of a net in which openings having a predetermined size are arranged. Among the first sorted substances dropping from the sorting unit 40, fine particles having a size to the extent that it is possible to pass through the mesh of the net fall downward from the mesh belt 46, and fibers having a size to the extent that it is not possible to pass through the mesh of the net are accumulated on the mesh belt 46 and are conveyed along with the mesh belt 46 in an arrow direction. The fine particles falling from the mesh belt 46 include a relatively small substance or a substance having low density (such as a resin grain, a coloring agent, or an additive) of the defibrated substances and are substances to be removed, which are not used in manufacturing of a sheet S by the sheet manufacturing apparatus 100.

The mesh belt 46 moves at a constant speed V1 at the time of a normal operation of manufacturing the sheet S. Here, the time of the normal operation means a time of an operation excluding times of execution of start control and stop control of the sheet manufacturing apparatus 100 to be described below and, to be more specific, indicates while the sheet manufacturing apparatus 100 manufactures the sheet S having a desired quality.

Hence, the defibrated substances subjected to the defibrating process by the defibration unit 20 are sorted into the first sorted substances and the second sorted substances by the sorting unit 40, and the second sorted substances return to the defibration unit 20. In addition, the first web former 45 removes the substance to be removed from the first sorted substances. The rest of the first sorted substances obtained by removing the substance to be removed are materials suitable for manufacturing the sheet S, and the materials are accumulated on the mesh belt 46 so as to form a first web W1.

The suction unit 48 suctions air from below the mesh belt 46. The suction unit 48 is connected to a dust collecting unit 27 via a pipe 23. The dust collecting unit 27 is a filter-type or cyclone-type dust collecting device and separates fine particles from the air current. A trapping blower 28 (separating suction unit) is installed downstream of the dust collecting unit 27, and the trapping blower 28 suctions air from the dust collecting unit 27. In addition, air discharged by the trapping blower 28 is discharged out of the sheet manufacturing apparatus 100 through a pipe 29.

In this configuration, air from the suction unit 48 is suctioned by the trapping blower 28 through the dust collecting unit 27. In the suction unit 48, the fine particles that pass through the meshes of the net of the mesh belt 46 are suctioned along with the air and are set to the dust collecting unit 27 through the pipe 23. The dust collecting unit 27 separates the fine particles having passed through the mesh belt 46 from the air current so as to accumulate the fine particles.

Hence, fibers obtained by removing the substances to be removed from the first sorted substance are accumulated on the mesh belt 46 such that the first web W1 is formed. The trapping blower 28 performs suction, thereby, promoting to form the first web W1 on the mesh belt 46, and the substances to be removed are rapidly removed.

The humidified air generated by the humidifying unit 204 is supplied to a space including the drum portion 41. The first sorted substance is humidified with the humidified air inside the sorting unit 40. Consequently, it is possible to weaken attachment of the first sorted substance to the mesh belt 46 due to an electrostatic force and peel the first sorted substance from the mesh belt 46 easily. Further, it is possible to suppress attachment of the first sorted substance to an inner wall of the rotary body 49 or the housing portion 43 due to the electrostatic force. In addition, the suction unit 48 is capable of suctioning the substance to be removed efficiently.

In the sheet manufacturing apparatus 100, a configuration of sorting and separating the first defibrated substance and the second defibrated substance from each other is not limited to the sorting unit 40 that includes the drum portion 41. For example, a configuration may be employed, in which the defibrated substances subjected to the defibrating process by the defibration unit 20 are classified by a classifier. For example, it is possible to use a cyclone classifier, an elbow jet classifier, or an eddy classifier as the classifier. When the classifiers are used, it is possible to sort and separate the first sorted substance and the second sorted substance from each other. Further, the classifier can realize a configuration of separating and removing the substance to be removed, which includes a relatively small substance or a substance having low density (such as a resin grain, a coloring agent, or an additive) of the defibrated substances. For example, in the configuration, the fine particles contained in the first sorted substance may be removed from the first sorted substance by the classifier. In this case, it is possible to employ a configuration in which the second sorted substance returns to the defibration unit 20, for example, the substances to be removed are collected by the dust collecting unit 27, and the first sorted substance is sent to a pipe 54 without the substances to be removed.

In a conveyance route of the mesh belt 46, the humidifying unit 210 supplies air containing mist to a downstream side of the sorting unit 40. The mist which is fine particles of water generated by the humidifying unit 210 drops toward the first web W1 and supplies moisture to the first web W1. Consequently, it is possible to adjust an amount of moisture contained in the first web W1, and thus it is possible to suppress attachment or the like of a fiber to the mesh belt 46 due to the static electricity.

The sheet manufacturing apparatus 100 includes the rotary body 49 that divides the first web W1 accumulated on the mesh belt 46. The first web W1 is peeled from the mesh belt 46 and is divided by the rotary body 49 at a position at which the mesh belt 46 is bent by the stretching roller 47.

The first web W1 is a soft material having a web shape, which is formed of the accumulated fibers, and the rotary body 49 loosens the fibers of the first web W1 so as to perform a process of proceeding to a state in which it is easy to mix a resin with the fibers by the mixer 50 to be described below.

The rotary body 49 has any configuration; however, in the embodiment, it is possible to have a rotating vane shape by having a plate-shaped vane that rotates. The rotary body 49 is disposed at a position at which the vane comes into contact with the first web W1 peeled from the mesh belt 46. The rotary body 49 rotates (for example, rotates in a direction represented by an arrow R in the drawing), and thereby the vane collides with the first web W1, which is peeled from the mesh belt 46 so as to be conveyed, such that the first web is divided, and a subdivided body P is generated.

It is preferable that the rotary body 49 be installed at a position at which the vane of the rotary body 49 does not collide with the mesh belt 46. For example, it is possible to have a gap of 0.05 mm or larger and 0.5 mm or smaller between a distal end of the vane of the rotary body 49 and the mesh belt 46. In this case, it is possible to divide the first web W1 efficiently without damage to the mesh belt 46 by the rotary body 49.

The subdivided body P divided by the rotary body 49 drops to an inside of a pipe 7 so as to be transported (conveyed) to the mixer 50 along with an air current flowing in the inside of the pipe 7.

In addition, the humidified air generated by the humidifying unit 206 is supplied to a space including the rotary body 49. Consequently, it is possible to suppress a phenomenon in which the fibers are attached to the inside of the pipe 7 or the vane of the rotary body 49 due to static electricity. In addition, air having high humidity is supplied to the mixer 50 through the pipe 7, and thus it is possible to suppress an influence of the static electricity even in the mixer 50.

The mixer 50 communicates with an additive supply unit 52 that supplies an additive containing resin and the pipe 7 and includes the pipe 54, through which an air current containing the subdivided body P flows, and a mixing blower 56 (transport blower).

The subdivided body P is a fiber obtained by removing the substance to be removed from the first sorted substance having passed through the first sorting unit 40 as described above. The mixer 50 mixes the fiber configuring the subdivided body P and an additive containing resin.

In the mixer 50, the subdivided body P and the additive are conveyed while the mixing blower 56 generates an air current, and the subdivided body and the additive are mixed in the pipe 54. In addition, the subdivided body P is loosened in a process of flowing inside the pipe 7 and the pipe 54 so as to have a finer fiber shape.

The additive supply unit 52 (resin supply unit) is connected to the cartridge 303, in which the additive is accumulated, and supplies the additive inside the cartridge 303 to the pipe 54. The additive supply unit 52 temporarily stores the additive made of fine powder or fine particles inside the cartridge 303. The additive supply unit 52 has a discharge unit 52*a* (resin supply unit) for sending the temporarily stored additive to the pipe 54. The discharge unit 52*a* is provided with a feeder (not shown) for delivering the additive stored in the additive supply unit 52 to the pipe 54 and a shutter (not shown) for opening and closing a pipe channel through which the feeder is connected to the pipe 54. When the shutter is closed, for example, a pipe channel, through which the discharge unit 52*a* is connected to the pipe 54, or an opening is blocked, and thus supply of the additive from the additive supply unit 52 to the pipe 54 is stopped.

In a state in which the feeder of the additive supply unit 52 does not operate, the additive is not supplied to the pipe 54 from the additive supply unit 52; however, in a case or the like where a pressure in the pipe 54 is a negative pressure, there is a possibility that the additive will flow to the pipe 54 even when the additive supply unit 52 is stopped. Such flowing of the additive is not caused in a state in which the discharge unit 52*a* is closed. Hence, the discharge unit 52*a* is closed, and thereby it is possible to reliably block the flowing of the additive.

The additive that is supplied by the additive supply unit 52 includes a resin for binding a plurality of fibers. The resin is a thermoplastic resin or a thermosetting resin, and examples thereof include AS resin, ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, or polyether ether ketone. The resins above may be used individually or in a proper combination thereof. In other words, the additive may contain a single substance, may be a mixture, or may contain a plurality of types of particles that are each configured of a single or a plurality of substances. In addition, the additive may be have a fiber shape or a powder shape.

The resin contained in the additive is melted by being heated so as to cause a plurality of fibers to be bounded to each other. Hence, in a state in which the resin is mixed with the fibers, and the resin is not heated to a temperature at which the resin is melted, the fibers are not bound to each other.

In addition, an additive that is supplied by the additive supply unit 52 may contain a colorant for coloring the fibers, a clumping inhibitor for inhibiting the fibers from clumping or the resin from clumping, or a flame retardant for retarding progression of burning of fibers or the like, depending on a type of sheet to be manufactured, in addition to the resin that causes the fibers to be bound. In addition, an additive that does not contain the colorant may be colorless or have a light color to the extent that the resin looks colorless or may be white.

The subdivided body P dropping through the pipe 7 and the additive that is supplied by the additive supply unit 52 are suctioned to the inside of the pipe 54 due to the air current generated by the mixing blower 56 and pass through the inside of the mixing blower 56. An action of the air current generated by the mixing blower 56 and/or a rotary unit such as the vane included in the mixing blower 56 causes the additive and the fiber configured of the subdivided body P to be mixed, and a mixture (mixture of the first sorted substance and the additive) is transported to the accumulation unit 60 through the pipe 54.

A mechanism that mixes the first sorted substance and the additive is not particularly limited, and a mechanism that performs agitation by a vane which rotates at a high speed may be employed, or a mechanism of using rotation of a container such as a V-shaped mixer may be employed, and the mechanism may be installed in front or rear of the mixing blower 56.

The accumulation unit 60 introduces the mixture having passed through the mixer 50 from an introduction port 62 and loosens intertwined defibrated substances (fibers) so as to be dropped while the fibers are dispersed in the air. Further, in a case where the additive that is supplied from the additive supply unit 52 has a fiber shape, the accumulation unit 60 loosens the intertwined additives. Consequently, the accumulation unit 60 is capable of accumulating the mixture in the second web former 70 with good uniformity.

In the embodiment, the accumulation unit 60 has a drum portion 61 (drum) and a housing portion (cover portion) 63 that accommodates the drum portion 61. The drum portion 61 is a cylinder sieve that is rotatably driven by a motor. The drum portion 61 has a net (a filter or a screen) and functions as a sieve. The drum portion 61 allows fibers or particles that are smaller than a mesh opening (opening) of the net through the mesh of the net and to be dropped from the drum portion 61. For example, a configuration of the drum portion 61 is the same as the configuration of the drum portion 41.

The "sieve" of the drum portion 61 may not have a function of sorting a specific target object. In other words, the "sieve" used as the drum portion 61 means a member having a net, and the drum portion 61 may allow the entire mixture introduced to the drum portion 61 to be dropped.

The second web former 70 is disposed below the drum portion 61. The second web former 70 (web former) accumulates passing substances having passed through the accumulation unit 60, and a second web W2 (accumulated substance) is formed. For example, the second web former 70 includes a mesh belt 72 (belt), a stretching roller 74, and a suction mechanism 76.

The mesh belt 72 is an endless belt, is suspended on a plurality of stretching rollers 74, and is conveyed along with motion of the stretching rollers 74 in a direction represented by an arrow in the drawing. For example, the mesh belt 72 is made of metal, resin, fabric, or nonwoven fabric. The mesh belt 72 has a surface configured of a net in which openings having a predetermined size are arranged. Among the first fibers or particles dropping from the drum portion 61, fine particles having a size to the extent that it is possible to pass through the mesh of the net fall downward from the mesh belt 72, and fibers having a size to the extent that it is not possible to pass through the mesh of the net are accumulated on the mesh belt 72 and are conveyed along with the mesh belt 72 in an arrow direction. The mesh belt 72 moves at a constant speed V2 at the time of a normal operation of manufacturing the sheet S. The time of the normal operation has a meaning as described above.

The mesh belt 72 has minute meshes of the net, and the mesh can have a size so as not to allow most of the fibers or particles dropping from the drum portion 61 to pass through the mesh belt.

The suction mechanism 76 is provided below the mesh belt 72 (on a side opposite to a side of the accumulation unit 60). The suction mechanism 76 includes a suction blower (not shown), and thus it is possible to generate an air current (air current toward the mesh belt 72 from the accumulation unit 60) toward below the suction mechanism 76 with a suction force of the suction blower.

The suction mechanism 76 suctions mixtures dispersed in the air by the accumulation unit 60 to the mesh belt 72. Consequently, it is possible to promote forming of the second web W2 on the mesh belt 72 and to increase a discharge speed from the accumulation unit 60. Further, the suction mechanism 76 is capable of forming a down flow in a falling route of the mixture and preventing the defibrated substances and the additive from being intertwined during falling.

The suction blower (accumulating suction unit) may discharge air suctioned from the suction mechanism 76 to the outside of the sheet manufacturing apparatus 100 through a trapping filter not shown. Alternatively, the air suctioned by the suction blower may be sent into the dust collecting unit 27, and the substance to be removed, which is contained in the air suctioned by the suction mechanism 76, may be trapped.

The humidified air generated by the humidifying unit 208 is supplied to a space including the drum portion 61. It is possible to humidify an inside of the accumulation unit 60 with the humidified air, and thus it is possible to suppress the fibers or the particles from being attached to the housing portion 63 due to the electrostatic force, to drop the fibers and the particles rapidly to the mesh belt 72, and to form the second web W2 into a preferable shape.

As described above, through the accumulation unit 60 and the second web former 70 (a web forming step), the second web W2 is formed in a state of containing a large amount of air and being soft and expanded. The second web W2 accumulated on the mesh belt 72 is conveyed to the sheet former 80.

In a conveyance route of the mesh belt 72, the humidifying unit 212 supplies air containing mist to a downstream side of the accumulation unit 60. Consequently, the mist which is generated by the humidifying unit 212 is supplied to the second web W2, and an amount of moisture contained in the second web W2 is adjusted. Consequently, it is possible to suppress attachment or the like of a fiber to the mesh belt 72 due to the static electricity.

The sheet manufacturing apparatus 100 includes the conveying unit 79 that is provided to convey the second web W2 on the mesh belt 72 to the sheet former 80. For example, the conveying unit 79 includes a mesh belt 79*a*, a stretching roller 79*b*, and a suction mechanism 79*c*.

The suction mechanism 79*c* has a blower (not shown) and generates an upward air current from the mesh belt 79*a* with a suction force of the blower. The second web W2 is suctioned along with the air current, and the second web W2 is separated from the mesh belt 72 so as to be attached to the mesh belt 79*a*. The mesh belt 79*a* moves along with rotation of the stretching roller 79*b* and conveys the second web W2 to the sheet former 80. For example, a movement speed of the mesh belt 72 is the same as a movement speed of the mesh belt 79*a*.

In this manner, the conveying unit 79 peels the second web W2 formed on the mesh belt 72 from the mesh belt 72 so as to transport the second web.

The sheet former 80 pressurizes and heats the second web W2 which is accumulated on the mesh belt 72 and conveyed by the conveying unit 79 so as to form the sheet S. In the sheet former 80, fibers of a defibrated substance and an additive which are contained in the second web W2 are heated, and thereby a plurality of fibers in a mixture are bound to each other via the additive (resin).

The sheet former 80 has a pressurizing unit 82 that pressurizes the second web W2 and a heating unit 84 that heats the second web W2 pressurized by the pressurizing unit 82. The pressurizing unit 82 and the heating unit 84 configure a former roller unit 83.

The pressurizing unit 82 is configured of a pressurizing roller pair 85 and nips and pressurizes the second web W2 with a predetermined nip pressure. The second web W2 decreases in thickness by being pressurized, and density of the second web W2 increases.

The pressurizing roller pair 85 rotates by a drive force of a motor (not shown) so as to convey the second web W2 having high density due to pressurization, toward the heating unit 84.

For example, the heating unit 84 can be configured to use a heating roller (heater roller), a thermal press forming device, a hot plate, a hot air blower, an infrared heater, or a flash fixing device. In the embodiment, the heating unit 84 is configured of a heating roller pair 86, and the heating roller pair 86 is warmed to a preset temperature by an external heating roller that is installed outside. The heating roller pair 86 nips the second web W2 pressurized by the pressurizing roller pair 85 so as to apply heat to the second web, and the sheet S is formed.

The heating roller pair 86 conveys the heated sheet S toward the cutter 90.

The cutter 90 (cutter unit) cuts the sheet S formed by the sheet former 80. In the embodiment, the cutter 90 includes a first cutter 92 that cuts the sheet S in a direction intersecting a conveyance direction of the sheet S and a second cutter 94 that cuts the sheet S in a direction parallel to the conveyance direction. For example, the second cutter 94 cuts the sheet S having passed through the first cutter 92.

As described above, a single sheet S having a predetermined size is formed. The cut single sheet S is discharged to a discharge unit 96. The discharge unit 96 has the paper discharge tray 313 or a stacker in which the sheets S having a predetermined size are placed.

In the above-described configuration, the humidifying units 202, 204, 206, and 208 may be configured to be vaporization-type humidifiers. In this case, a configuration may be employed, in which humidified air generated by one humidifier diverges to be supplied to the rough crushing unit 12, the housing portion 43, the pipe 7, and the housing portion 63. In the configuration, a duct (not shown), through which the humidified air is supplied, is installed to diverge, and thereby it is possible to easily realize supply of the humidified air. In addition, it is needless to say that the humidifying units 202, 204, 206, and 208 can be each configured of two or three vaporization-type humidifiers. In the embodiment, as will be described below, the humidified air is supplied to the humidifying units 202, 204, 206, and 208 from a vaporization-type humidifier (not shown).

In addition, in the above-described configuration, the humidifying units 210 and 212 may be configured of one ultrasound type humidifier or may be configured of two ultrasound type humidifier. For example, it is possible to employ a configuration in which air containing mist generated by one humidifier diverges to be supplied to the humidifying unit 210 and the humidifying unit 212. In the embodiment, a mist-type humidifier humidifier (not shown) supplies the air containing the mist to the humidifying units 210 and 212.

In addition, the blowers included in the sheet manufacturing apparatus 100 described above are not limited to the defibration unit blower 26, the trapping blower 28, the mixing blower 56, the blower of the suction mechanism 76, and the blower of the suction mechanism 79*c*. For example, it is needless to say that an air blower that assists the blowers described above can be provided to the duct.

In addition, in the above-described configuration, the rough crushing unit 12 first roughly crushes the raw material, and the sheet S is manufactured from the roughly crushed raw material; however, it is also possible to employ a configuration in which the sheet S is manufactured by using the fibers as the raw material.

For example, a configuration may be employed, in which it is possible to feed, as the raw material, fibers equivalent to the defibrated substances subjected to the defibrating process by the defibration unit 20, to the drum portion 41. In addition, a configuration may be employed, in which it is possible to feed, as the raw material, fibers equivalent to the first sorted substances separated from the defibrated substances to the pipe 54. In this case, fibers obtained by processing used paper, pulp, or the like are supplied to the sheet manufacturing apparatus 100, and thereby it is possible to manufacture the sheet S.

Next, the sheet former 80 will be described in detail.

Figure 4:
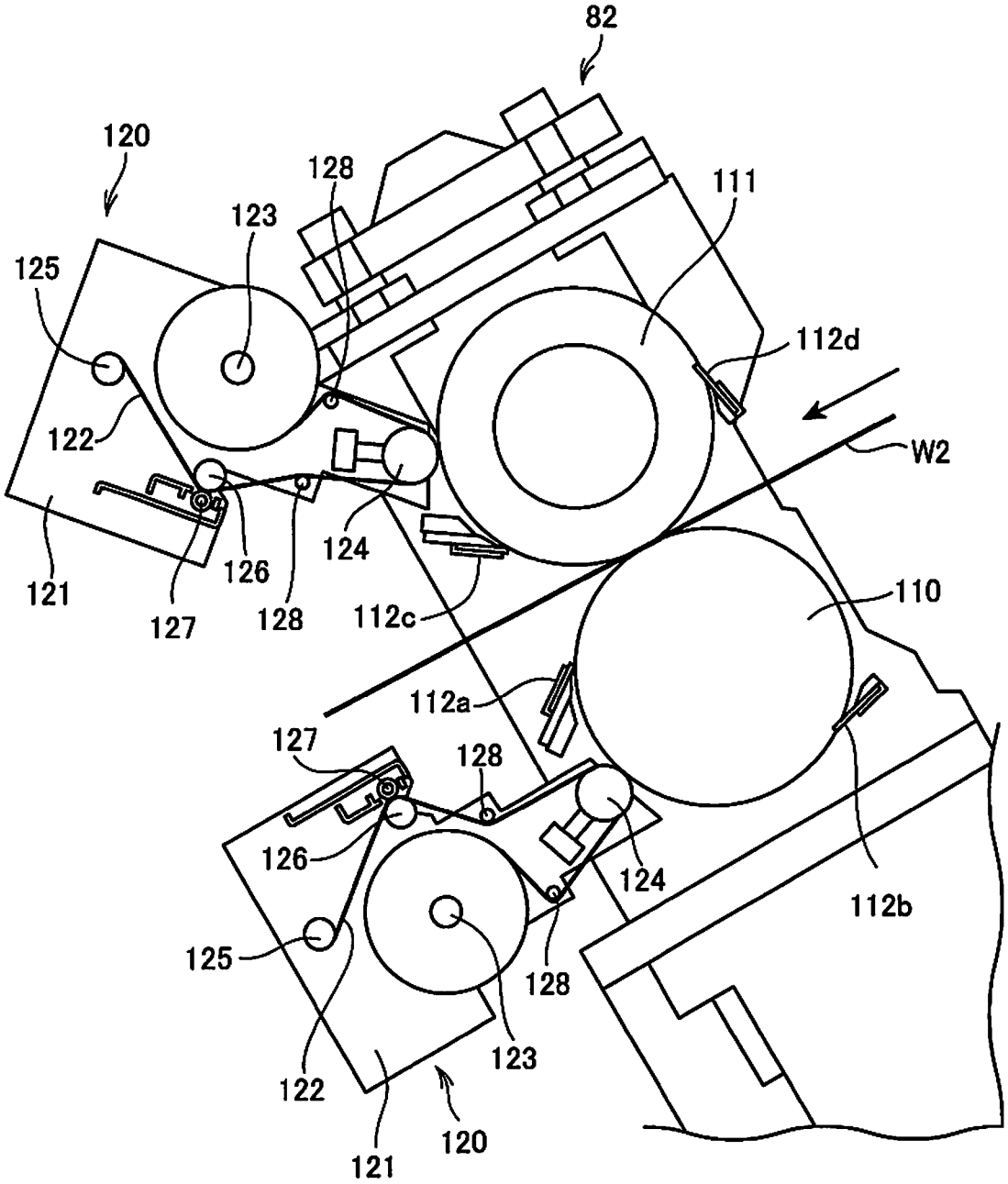
FIG. 4 is a view of a schematic configuration showing a pressurizing unit.
Figure 5:
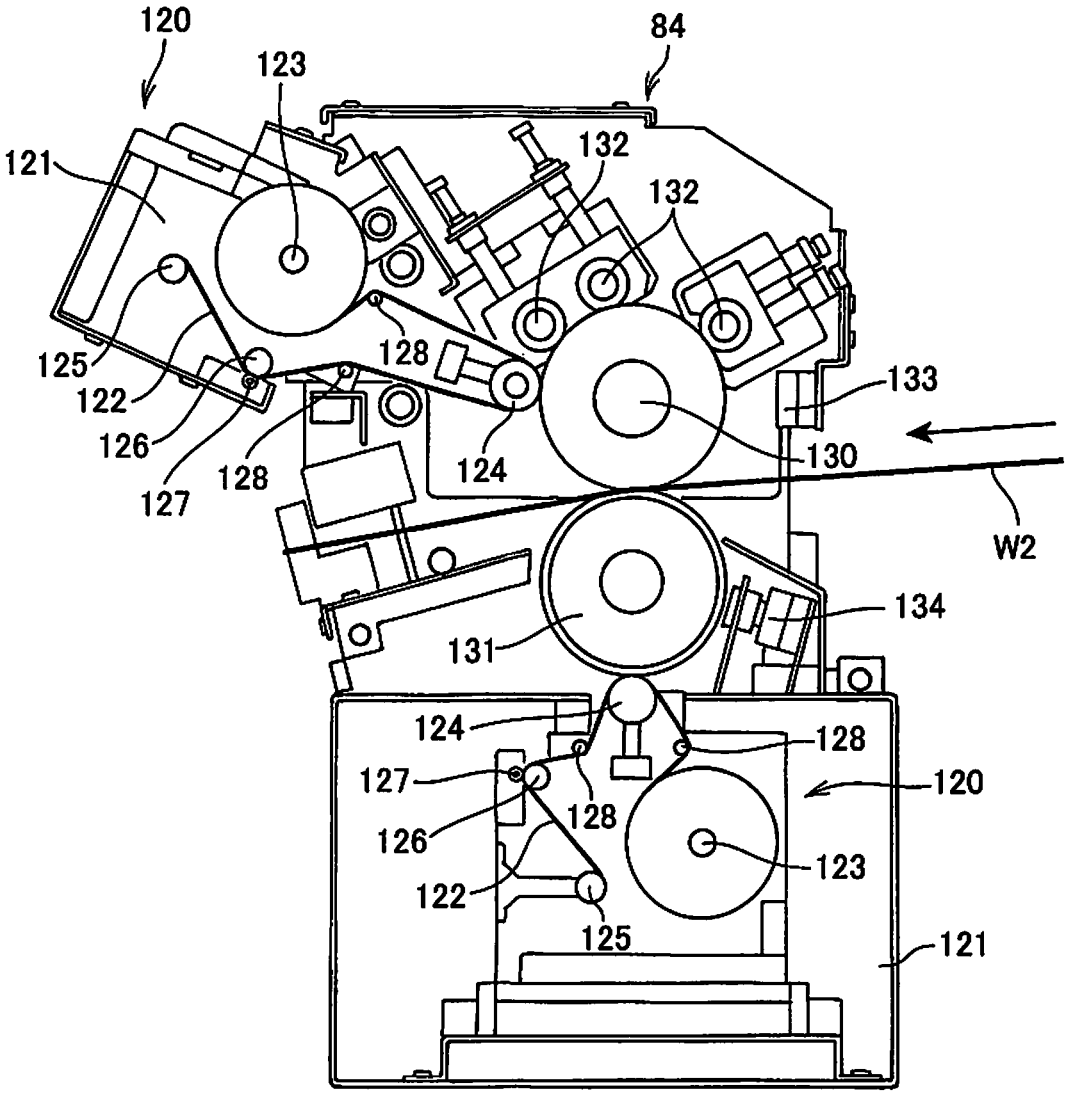
FIG. 5 is a view of a schematic configuration showing a heating unit.

FIG. 4 is a view of a schematic configuration of the pressurizing unit 82. FIG. 5 is a view of a schematic configuration of the heating unit 84.

First, the pressurizing unit 82 of the sheet former 80 will be described with reference to FIG. 4.

The pressurizing roller pair 85 of the pressurizing unit 82 is configured to have a pressurizing drive roller 110 that is rotatably driven by a motor (not shown) and a pressurizing driven roller 111 that comes into press contact with the pressurizing drive roller 110. Since the pressurizing drive roller 110 has a low surface temperature and a hard surface, the pressurizing drive roller 110 and the pressurizing driven roller 111 are brought into press contact with each other with a high pressure contact force.

Scraping blades 112*a* and 112*b* are disposed on an outer circumference of the pressurizing drive roller 110 on an upstream side and a downstream side in a rotating direction of the pressurizing drive roller 110, respectively.

The scraping blades 112*a* and 112*b* are disposed to tilt with respect to a circumferential surface of the pressurizing drive roller 110, and the scraping blades 112*a* and 112*b* are configured to scrape the attached matter of the second web W2 attached on an outer circumferential surface of the pressurizing drive roller 110.

A cleaning unit 120 is disposed between the scraping blades 112*a* and 112*b* of the pressurizing drive roller 110.

The cleaning unit 120 has a frame 121. A web delivery roller 123, around which elongated oil impregnated web 122 is wound, is rotatably attached to the frame 121.

For example, the oil impregnated web 122 is formed of PET fiber and aramid fiber and is an elongated thin sheet formed to have a thickness of 40 μm. For example, the oil impregnated web 122 is impregnated with oil such as silicon oil. For example, an impregnation amount of oil is 15 g/m$^2$.

The oil impregnated web 122 has a width wider than a width (length in a direction intersecting the conveyance direction) of the second web W2 that is conveyed to the pressurizing unit 82.

A web press-contact roller 124, which causes the oil impregnated web 122 delivered from the web delivery roller 123 to come into press contact with the pressurizing drive roller 110, is rotatably attached to the frame 121.

A web winding roller 125, around which the oil impregnated web 122 that is sent from the web press-contact roller 124 is wound, is attached to the frame 121.

A web feed roller 126 is disposed between the web press-contact roller 124 and the web winding roller 125 of the frame 121, and the web feed roller 126 is rotatably driven by a motor (not shown). A web driven roller 127 is brought into press contact with the web feed roller 126, and the oil impregnated web 122 is nipped between the web feed roller 126 and the web driven roller 127.

A guide pin 128 that guide the oil impregnated web 122 is disposed at each of positions between the web delivery roller 123 and the web press-contact roller 124, and between the web press-contact roller 124 and the web feed roller 126.

The web feed roller 126 is rotatably driven, and thereby the oil impregnated web 122 nipped between the web driven roller 127 and the web feed roller is conveyed.

The conveying direction of the oil impregnated web 122 is an opposite direction to the rotating direction of the pressurizing drive roller 110. In addition, the web feed roller 126 is rotatably driven intermittently, and thereby the oil impregnated web 122 is conveyed intermittently. For example, the intermittent conveyance of the oil impregnated web 122 is performed by 1 mm per six seconds.

The oil impregnated web 122 is conveyed intermittently in the opposite direction to the conveyance direction of the second Web W2, and thereby the oil impregnated web 122 blocks the attached matter on the surface of the pressurizing drive roller 110 when the conveyance of the oil impregnated web 122 is stopped. Then, when the oil impregnated web 122 is conveyed, the blocked attached matter is caused to be attached to the oil impregnated web 122 so as to be removed.

Such conveyance makes it possible to remove the attached matter on the surface of the pressurizing drive roller 110 efficiently.

In addition, the web delivery roller 123 has a torque limiter the oil (not shown) internally and is configured to deliver the oil impregnated web 122, only in a case where a force having a predetermined strength or higher is applied.

Consequently, in a state in which the conveyance of the oil impregnated web 122 is stopped, constant tension is applied to the oil impregnated web 122 by the torque limiter of the delivery roller. Therefore, the oil impregnated web 122 is unlikely to be conveyed along with the rotation of the pressurizing drive roller 110.

In addition, the web winding roller 125 has a torque limiter (not shown) internally, and a rotative force is always applied to the web winding roller 125 by a motor (not shown). Therefore, in a case where the rotative force of the web winding roller 125 is released by the torque, and the oil impregnated web 122 is conveyed by the web feed roller 126, the oil impregnated web is wound only by an amount of conveyance.

For example, the web delivery roller 123 has a terminal end detecting sensor (not shown) configured of an optical sensor or the like internally. For example, the terminal end detecting sensor is configured of a light emitting element and a light receiving element, light from the light emitting element is emitted toward the oil impregnated web 122, and light that transmits through the oil impregnated web 122 is received by the light receiving element.

In a case where a large amount of the oil impregnated web 122 is wound around the web delivery roller 123, the light from the light emitting element cannot transmit through the oil impregnated web 122 and cannot be received by the light receiving element. When a small amount of the oil impregnated web 122 is wound around the web delivery roller 123, the light from the light emitting element can transmit through the oil impregnated web 122 and can be received by the light receiving element.

In a case where the light is received by the light receiving element, it is possible to determine that a small amount of the oil impregnated web 122 is wound around the web delivery roller 123.

The cleaning unit 120 configured as described above is configured as one unit including members. The cleaning unit 120 is replaceable on a unit basis. Since the oil impregnated web 122 of the cleaning unit 120 is a consumable item, it is possible to perform replacement on a unit basis, and thereby easy maintenance is achieved.

In addition, scraping blades 112*c* and 112*d* are disposed on an outer circumference of the pressurizing driven roller 111 on the upstream side and the downstream side in a rotating direction of the pressurizing driven roller 111, respectively.

The scraping blades 112*c* and 112*d* are disposed to tilt with respect to a circumferential surface of the pressurizing driven roller 111, and the scraping blades 112*c* and 112*d* are configured to scrape the attached matter of the second web W2 attached on an outer circumferential surface of the pressurizing driven roller 111.

A cleaning unit 120 is disposed on the outer circumference of the pressurizing driven roller 111 and between the scraping blades 112*c* and 112*d* of the pressurizing driven roller 111.

A configuration of the cleaning unit 120 is the same as the configuration of the cleaning unit disposed on the circumference of the pressurizing drive roller 110 described above. Therefore, the same reference signs are assigned to the same parts, and thus the description thereof is omitted.

Next, the heating unit 84 will be described with reference to FIG. 5.

The heating roller pair 86 of the heating unit 84 is configured to have a heating drive roller 131 that is rotatably driven by a motor (not shown) and a heating driven roller 130 that comes into press contact with the heating drive roller 131.

The heating drive roller 131 and the heating driven roller 130 are brought into press contact with each other with a pressure contact force weaker than the pressure contact force with which the pressurizing drive roller 110 and the pressurizing driven roller 111 are brought into press contact with each other. The second web W2 that is conveyed between the heating drive roller 131 and the heating driven roller 130 receives heat of the heating drive roller 131 and the heating driven roller 130, and the resin in the second web W2 is melted such that the sheet S is formed.

A heat source (not shown) such as a motor is provided inside (on an inner circumferential side of) the heating drive roller 131.

An external heating roller 132 for heating the heating driven roller 130 is disposed on the outer circumference of the heating driven roller 130. The external heating roller 132 is configured of two external heating rollers 132 that abut the outer circumference of the heating driven roller 130 and one external heating roller 132 that is positioned on the downstream side in the rotating direction of the heating driven roller 130 from the two external heating rollers 132. It is possible to optionally set the number and disposition of the external heating rollers 132.

A temperature sensor 133 that detects a surface temperature of the heating driven roller 130 is disposed on a downstream side in the rotating direction of the heating driven roller 130 from the external heating roller 132. For example, the temperature sensor 133 is a non-contact sensor such as an infrared radiation sensor that detects radiation heat from the surface of the heating driven roller 130.

A cleaning unit 120 is disposed on an outer circumferential side of the heating driven roller 130 on the upstream side in the rotating direction of the heating driven roller 130 from the external heating roller 132.

The configuration of the cleaning unit 120 is the same as the configuration of the cleaning unit disposed on the circumference of the pressurizing drive roller 110 described above. Therefore, the same reference signs are assigned to the same parts, and thus the description thereof is omitted.

The web press-contact roller 124 of the cleaning unit 120 is disposed on the upstream side of the external heating roller 132, and thereby it is possible to remove the attached matter attached on the surface of the heating driven roller 130, by the time of reaching the external heating roller 132. Consequently, when the surface of the heating driven roller 130 is heated by the external heating roller 132, it is possible to prevent the attached matter from being interposed between the heating driven roller 130 and the external heating roller 132, and it is possible to uniformly heat the surface of the heating driven roller 130.

In addition, by the time of reaching the temperature sensor 133, it is possible to remove the attached matter attached on the surface of the heating driven roller 130, and thus no error occurs to a temperature detection value by the temperature sensor 133 due to the attached matter.

For example, a temperature sensor 134 such as an infrared radiation sensor, which detects a surface temperature of the heating drive roller 131, is disposed on the outer circumference of the heating drive roller 131.

A cleaning unit 120 is disposed on an outer circumferential side of the heating drive roller 131 on the upstream side in the rotating direction of the heating drive roller 131 from the temperature sensor 134.

The configuration of the cleaning unit 120 is the same as the configuration of the cleaning unit disposed on the circumference of the pressurizing drive roller 110 described above. Therefore, the same reference signs are assigned to the same parts, and thus the description thereof is omitted.

The web press-contact roller 124 of the cleaning unit 120 is disposed on the upstream side of the temperature sensor 134. In this manner, by the time of reaching the temperature sensor 134, it is possible to remove the attached matter attached on the surface of the heating drive roller 131, and thus no error occurs to a temperature detection value by the temperature sensor 134 due to the attached matter.

Next, an operation in the sheet former 80 of the embodiment will be described.

When the second web W2 accumulated on the mesh belt 72 is conveyed between the pressurizing drive roller 110 and the pressurizing driven roller 111, the second web W2 is conveyed while being nipped and pressurized between the pressurizing drive roller 110 and the pressurizing driven roller 111.

The second web W2 decreases in thickness by being pressurized, and density of the second web W2 increases.

The pressurizing drive roller 110 and the pressurizing driven roller 111 rotate with a drive force from a motor (not shown) so as to convey the second web W2 having high density due to pressurization, toward the heating unit 84.

The attached matter of the second web W2 attached on the surface of the pressurizing drive roller 110 and the pressurizing driven roller 111 is scraped both the scraping blades 112*a* and 112*c*.

After the attached matter is scraped by the scraping blades 112*a* and 112*c*, the oil impregnated web 122 is brought into press contact to the surface of the pressurizing drive roller 110 and the pressurizing driven roller 111 by the web press-contact roller 124 of the cleaning unit 120. The oil impregnated web 122 is conveyed intermittently. Therefore, when the conveyance of the oil impregnated web 122 is stopped, the oil impregnated web 122 blocks the accumulated substance on the surface of the pressurizing drive roller 110 and the pressurizing driven roller 111. Then, when the oil impregnated web 122 is conveyed, the blocked accumulated substance is caused to be attached to the oil impregnated web 122 so as to be removed.

When the pressurizing drive roller 110 and the pressurizing driven roller 111 further rotate, the attached matter of the second web W2 attached on the surface is scraped both the scraping blades 112*b* and 112*d* μm the downstream side of the rotating direction. In this case, since the surface of the pressurizing drive roller 110 and the pressurizing driven roller 111 is applied with oil by the oil impregnated web 122, the scraping blades 112*b* and 112*d* on the downstream side easily scrape the attached matter. Therefore, it is possible to scrape the attached matter attached on the surface of the pressurizing drive roller 110 and the pressurizing driven roller 111 efficiently.

The attached matter is removed in order, by the scraping blades 112*a* and 112*c* on the upstream side, the cleaning unit 120, and the scraping blades 112*b* and 112*d* on the downstream side. Consequently, it is possible to prevent the attached matter from being transferred to the second web W2 in a nipping portion in which the second web W2 is nipped by the pressurizing drive roller 110 and the pressurizing driven roller 111.

Next, when the second web W2 is conveyed to the heating unit 84 from the pressurizing unit 82, the second web W2 is nipped and heated between the heating drive roller 131 and the heating driven roller 130 which are heated to a predetermined temperature. Consequently, the additive (resin) contained in the second web W2 is melted, a plurality of fibers in the mixture are bound via the additive (resin) to each other, and the sheet is formed.

The web press-contact roller 124 of the cleaning unit 120 causes the oil impregnated web 122 to be brought into press-contact with the surface of the heating drive roller 131 and the heating driven roller 130. The oil impregnated web 122 is conveyed intermittently. Therefore, when the conveyance of the oil impregnated web 122 is stopped, the oil impregnated web 122 blocks the accumulated substance on the surface of the heating drive roller 131 and the heating driven roller 130. Then, when the oil impregnated web 122 is conveyed, the blocked accumulated substance is caused to be attached to the oil impregnated web 122 so as to be removed.

After the attached matter attached on the surface of the heating driven roller 130 is removed by the cleaning unit 120, the external heating roller 132 abuts the surface of the heating driven roller 130.

Consequently, when the surface of the heating driven roller 130 is heated by the external heating roller 132, it is possible to prevent the attached matter from being interposed between the heating driven roller 130 and the external heating roller 132, and it is possible to uniformly heat the surface of the heating driven roller 130.

After the external heating roller 132 is heated, the temperature sensor 133 detects a surface temperature of the heating driven roller 130. In addition, by the time of reaching the temperature sensor 133, it is possible to remove the attached matter attached on the surface of the heating driven roller 130, and thus it is possible to prevent an error from occurring to the temperature detection value by the temperature sensor 133 due to the attached matter.

Also regarding the heating drive roller 131, by the time of reaching the temperature sensor 133, it is possible to remove the attached matter attached on the surface of the heating drive roller 131, and thus it is possible to prevent an error from occurring to the temperature detection value by the temperature sensor 133 due to the attached matter.

As described above, according to the embodiment to which the invention is applied, the sheet former 80 has the former roller unit 83 and the cleaning unit 120 that has the oil impregnated web 122 for cleaning a roller surface of the former roller unit 83.

In this manner, since it is possible to remove the attached matter attached on the roller surface of the former roller unit 83 by the oil impregnated web 122 of the cleaning unit 120, it is possible to prevent the attached matter from being transferred to the second web W2 (web) on the former roller unit 83. As a result, it is possible to improve a quality of the sheet (achieve evenness) without forming an uneven surface of the sheet to be formed.

In addition, according to the embodiment, the cleaning unit 120 has the web delivery roller 123, the web winding roller 125, the web press-contact roller 124 that is brought into press contact with the roller surface via the oil impregnated web 122.

In this manner, since the oil impregnated web 122 is wound around the web winding roller 125 via the web press-contact roller 124 from the web delivery roller 123, it is possible to cause a new oil impregnated web 122 to come into press contact with the roller surface.

In addition, according to the embodiment, the former roller unit 83 has the pressurizing drive roller 110 and the pressurizing driven roller 111 (pressurizing roller pair 85). In addition, the rollers of the pressurizing drive roller 110 and the pressurizing driven roller 111 are each provided with the cleaning unit 120.

In this manner, it is possible to clean the pressurizing drive roller 110 and the pressurizing driven roller 111 individually by the cleaning unit 120.

In addition, according to the embodiment, the former roller unit 83 has scraping blades 112*b* and 112*d* for removing the attached matter on the roller surface of the pressurizing drive roller 110 and the pressurizing driven roller 111 (pressurizing roller pair 85). In addition, the cleaning unit 120 performs cleaning on the upstream side of the scraping blades 112*b* and 112*d*.

In this manner, when the scraping blades 112*b* and 112*d* scrape the attached matter, the oil is applied on the surface of the pressurizing drive roller 110 and the pressurizing driven roller 111 by the oil impregnated web 122. Therefore, the attached matter is likely to be scraped by the scraping blades 112*b* and 112*d*, and it is possible to scrape the attached matter attached on the surface of the pressurizing drive roller 110 and the pressurizing driven roller 111.

In addition, according to the embodiment, the former roller unit 83 has the scraping blades 112*a* and 112*c* for removing the attached matter on the roller surface of the pressurizing drive roller 110 and the pressurizing driven roller 111 (pressurizing roller pair 85). The cleaning unit 120 performs cleaning on the downstream side of the scraping blades 112*a* and 112*c*.

In this manner, after the attached matter is scraped by the scraping blades 112*a* and 112*c*, the cleaning unit 120 performs cleaning. Therefore, after relatively large attached matter is removed by the scraping blades 112*a* and 112*c*, it is possible to remove fine attached matter by the cleaning unit 120.

In addition, according to the embodiment, the former roller unit 83 has the heating drive roller 131 and the heating driven roller 130 (heating roller pair 86). In addition, the rollers of the heating drive roller 131 and the heating driven roller 130 are each provided with the cleaning unit 120.

In this manner, it is possible to clean the heating drive roller 131 and the heating driven roller 130 individually by the cleaning unit 120.

In addition, according to the embodiment, the external heating roller 132 that heats at least one heating driven roller 130 from outside, of the heating drive roller 131 and the heating driven roller 130 (heating roller pair). In addition, the cleaning unit 120 performs cleaning on the upstream side of the external heating roller 132.

In this manner, by the time of reaching the external heating roller 132, it is possible to remove the attached matter attached on the surface of the heating driven roller 130. Consequently, when the surface of the heating driven roller 130 is heated by the external heating roller 132, it is possible to prevent the attached matter from being interposed between the heating driven roller 130 and the external heating roller 132, and it is possible to uniformly heat the surface of the heating driven roller 130.

In addition, according to the embodiment, the oil impregnated web 122 of the cleaning unit 120 is conveyed in a reverse direction of a roller rotating direction of the former roller unit 83.

In this manner, since the oil impregnated web 122 is conveyed in the reverse direction of the roller rotating direction of the former roller unit 83, it is possible to remove the attached matter on the surface of the roller by the oil impregnated web 122 while blocking the attached matter. As a result, it is possible to remove the surface attached matter of the roller efficiently.

In addition, according to the embodiment, the oil impregnated web 122 of the cleaning unit 120 is conveyed intermittently.

In this manner, since the oil impregnated web 122 is conveyed intermittently, the oil impregnated web 122 blocks the attached matter on the surface of the roller when the conveyance of the oil impregnated web 122 is stopped. Then, when the oil impregnated web 122 is conveyed, it is possible to attach the blocked attached matter to the oil impregnated web 122 so as to get rid of the attached matter, and it is possible to remove the surface attached matter of the roller efficiently.

In addition, according to the embodiment, the cleaning unit 120 is replaceable on a unit basis.

In this manner, since the oil impregnated web 122 of the cleaning unit 120 is a consumable item, it is possible to perform replacement on a unit basis, and thereby easy maintenance is achieved.

As described above, an embodiment of the invention is described; however, the present invention is not limited thereto, and it is possible to modify the present invention in various ways as necessary.

For example, according to the embodiment described above, a case where the present invention is applied to the dry type sheet manufacturing apparatus is described; however, the present invention is not limited thereto, and the present invention can also be applied to a wet type sheet manufacturing apparatus.

REFERENCE SIGNS LIST

10 supply unit
20 defibration unit
40 sorting unit
50 mixer
60 accumulation unit
70 second web former
80 sheet former
82 pressurizing unit
83 former roller unit
84 heating unit
85 pressurizing roller pair
86 heating roller pair
90 cutter
100 sheet manufacturing apparatus
110 pressurizing drive roller
111 pressurizing driven roller
112 scraping blade
120 cleaning unit
121 frame
122 oil impregnated web
123 web delivery roller
124 web press-contact roller
125 web winding roller
126 web feed roller
127 web driven roller
128 guide pin
130 heating driven roller
131 heating drive roller
132 external heating roller
133, 134 temperature sensor
S sheet
W2 second web

The invention claimed is:

1. A sheet manufacturing apparatus comprising:

a web former that forms a web of defibrated substances obtained by defibrating a raw material containing fibers; and a sheet former that forms a sheet of the web formed by the web former, the sheet former including a former roller unit, the former roller unit having a pressurizing roller pair that pressurizes and heats the web formed by the web former so as to form a sheet, cleaning units each of which has an oil impregnated web and that clean roller surfaces of rollers of the pressurizing roller pair, respectively, and downstream scraping blades that remove attached matter on the roller surfaces of the rollers of the pressurizing roller pair, respectively, each of the downstream scraping blades being disposed, in a roller rotating direction of each of the rollers, between a nip portion of the pressurizing roller pair and each of the cleaning units and disposed downstream relative to each of the cleaning units in the roller rotating direction, each of the cleaning units cleaning each of the roller surfaces of the rollers, which has passed through the nip portion, on an upstream side of each of the downstream scraping blades in the roller rotating direction.

2. The sheet manufacturing apparatus according to claim 1, wherein each of the cleaning units has a web delivery roller that delivers the oil impregnated web, a web winding roller around which the oil impregnated web is wound, and a web press-contact roller that is disposed between the web delivery roller and the web winding roller and comes into press contact with each of the roller surfaces of the pressurizing roller pair via the oil impregnated web.

3. The sheet manufacturing apparatus according to claim 1, wherein the former roller unit further has upstream scraping blades that remove the attached matter on the roller surfaces of the rollers of the pressurizing roller pair, respectively, and each of the upstream scraping blades is disposed, in the roller rotating direction, between the nip portion and each of the cleaning units and disposed upstream relative to each of the cleaning units in the roller rotating direction, wherein each of the cleaning units cleans each of the roller surfaces of the rollers, which has passed through the nip portion, on a downstream side of each of the upstream scraping blades in the roller rotating direction.

4. The sheet manufacturing apparatus according to claim 1, wherein the former roller unit further has a heating roller pair, and wherein the sheet former further has cleaning units which clean rollers of the heating roller pair.

5. The sheet manufacturing apparatus according to claim 4, further comprising:

an external heating roller that heats at least one heating roller of the heating roller pair from outside, and wherein one of the cleaning units, which cleans the at least one heating roller, performs cleaning on an upstream side of the external heating roller.

6. The sheet manufacturing apparatus according to claim 1, wherein the oil impregnated web of each of the cleaning units is conveyed in a reverse direction of the roller rotating direction.

7. The sheet manufacturing apparatus according to claim 1, wherein the oil impregnated web of each of the cleaning units is conveyed intermittently.

8. The sheet manufacturing apparatus according to claim 1, wherein the cleaning units are replaceable on a unit basis.

* * * * *